United States Patent [19]

Folsberg

[11] Patent Number: 4,689,140

[45] Date of Patent: Aug. 25, 1987

[54] SEPARATOR FOR SORTING PARTICULATE MATERIAL

[75] Inventor: Jan Folsberg, Copenhagen, Denmark

[73] Assignee: F. L. Smidth & Co. A/S, Copenhagen, Denmark

[21] Appl. No.: 876,242

[22] Filed: Jun. 19, 1986

[30] Foreign Application Priority Data

Jul. 23, 1985 [GB] United Kingdom ..... 8518536

[51] Int. Cl.[4] ..... B07B 7/08

[52] U.S. Cl. ..... 209/139.2; 209/148

[58] Field of Search ..... 209/138, 139.2, 148, 209/146, 150, 154

[56] References Cited

U.S. PATENT DOCUMENTS

| | | | |
|---|---|---|---|
| 2,099,505 | 11/1937 | Weaver | 209/148 |
| 4,066,535 | 1/1978 | Strauss | 209/148 |
| 4,100,061 | 7/1978 | Eickholt et al. | 209/139.2 |
| 4,125,254 | 5/1979 | Steier et al. | 209/148 |
| 4,288,317 | 9/1981 | de Ruvo et al. | 209/148 |

FOREIGN PATENT DOCUMENTS

| | | | |
|---|---|---|---|
| 23320 | 2/1981 | European Pat. Off. | 209/150 |
| 352620 | 3/1920 | Fed. Rep. of Germany | 209/148 |
| 741958 | 6/1980 | U.S.S.R. | 209/139.2 |

*Primary Examiner*—Robert B. Reeves
*Assistant Examiner*—Donald T. Hajec
*Attorney, Agent, or Firm*—Brumbaugh, Graves, Donohue & Raymond

[57] ABSTRACT

A separator has a rotor (1) with top and bottom plates (2,3). An annular collecting casing (10) is secured to the top plate and is positioned at a radial distance from the material inlets (13). The casing has a concave side which faces the top plate (2) for collecting material (15) which is flung outwards from the top plate (2), and for discharging the material (19) downwards.

6 Claims, 2 Drawing Figures

SEPARATOR FOR SORTING PARTICULATE MATERIAL

The invention relates to a separator for sorting particulate material suspended in a conveying gas into a fine fraction and a course fraction, the separator comprising a vaned rotor rotatable about a vertical axis. The vanes extend between a bottom plate and a top plate of the rotor, the top plate comprising a distributing arrangement for distributing supplied, unsorted material to the rotor so as to suspend the material in the conveying gas. A housing encases the rotor and has an inlet for supply of the conveying gas to the rotor. An outlet at the upper end of the housing discharges the separated fine fraction. At least one inlet is provided in the housing for supply of unsorted particulate material to the upper side of the rotor top plate and an impact ring is positioned around and at a radial distance from the top plate.

A separator of the above kind is known from EP-A-0023320, cf. especially FIG. 10. This separator is shown with two inlet ducts for the supply of unsorted material. The inlet ducts are positioned at the top of the separator housing diametrically opposite each other in relation to the rotor axis and oriented down towards the upper end of the rotor top plate.

Unsorted material is passed down through the inlet ducts to the upper side of the top plate from where, due to the rotation of the top plate, it is flung outwards towards the surrounding impact ring where the material is stopped and falls down around the rotor, in this case inside a louvre system encasing the rotor.

The conveying gas in this case is directed towards the rotor via a louvre system and collects the falling material and forms a suspension of conveying gas and material around the rotor, which suspension is introduced into the rotor where coarser particles, in known manner, are flung outwards by the centrifugal force deriving from the rotation of the rotor, the finer particles remaining suspended in the conveying gas.

The separated coarser fraction flung outwards towards the louvre system is stopped by same and falls down towards the bottom of the separator into a collecting hopper for the coarse fraction. The finer fraction is passed by the conveying gas up through a central opening in the top plate of the rotor and discharged through the top of the separator to be separated from the conveying gas in a precipitator.

However, with a separator of the above kind it is impossible to achieve an even distribution of the supplied unsorted material around the rotor. This is due to the fact that all unsorted material passed to the upper side of the rotor top plate from an inlet duct is flung away from the top plate already at a rotation angle below 45°–90° after the inlet proper. Thus along the circumference of the rotor there is at least one zone with practically no material to be suspended in the conveying gas flowing into the rotor, which means an impaired utilization of the separator.

It is an object of the invention to remedy the above drawbacks, and this is achieved by means of an annular collecting casing, secured to and coaxial with the top plate and at a radial distance from the material inlet, the casing having a concave side facing the top plate for collecting material flung outwards from the top plate and for discharging the material downwards.

By means of the collecting casing rotating with the rotor, the material, when flung outwards from the upper side of the rotor top plate, is collected in the concave side of the collecting casing, thus causing the formation of a band of material inside the casing. By gravity the surface layer of this band slides down comparatively slowly to the lower edge of the collecting casing (due to a certain material sliding angle), from the edge of which it is flung outwards towards the surrounding impact ring where it is stopped and falls down around the rotor in known manner.

By collecting the material in the collecting casing and allowing it to slide down comparatively slowly a longer material retention time in the collecting casing is achieved, and consequently a distribution of downwardly falling material from the impact ring along the entire circumference of the rotor. Thereby is achieved a better suspension of the material in the conveying gas around the entire rotor compared with known separator types.

To ensure that all the material flung outwards from the rotor plate is collected by the collecting casing it is advantageous that the top plate have a distributing arrangement, for example, at least the outermost zone of the top plate may be covered by an annular guide plate, which is oriented obliquely upwards and outwards. At the same time it is achieved that the material flung outwards hits the surface of the material band on the collecting casing substantially perpendicularly.

To ensure fewest possible obstructions to the movement of the material out into the collecting casing the latter may advantageously be mounted on spokes secured to the top plate, preferably via the guide plate.

A separator according to the invention will now be described in more detail, reference being made to the accompanying diagrammatic drawings, in which.

Figure 1:
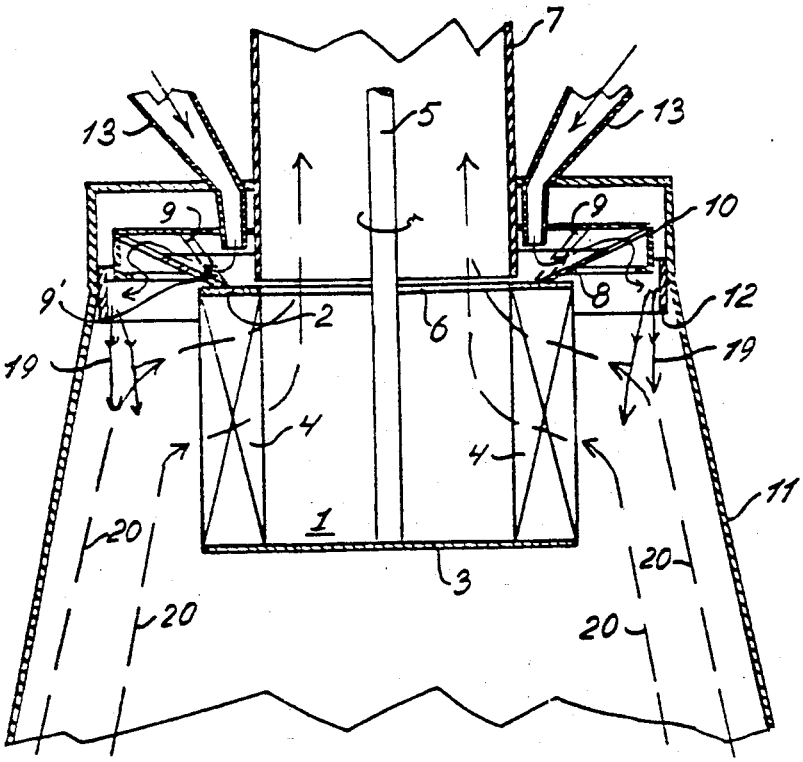
FIG. 1 is an axial section through the separator.

The separator shown has a rotor 1 with an annular top plate 2 and a solid bottom plate 3 between which rotor vanes 4 extend. The rotor 1 is driven by a vertical shaft 5 from a motor (not shown). The top plate 2 has a central opening 6 leading to an outlet duct 7 at the top of the separator for discharge of a separated fine fraction of the material.

At the upper end of the top plate 2 is mounted an annular, frusto-conical guide plate 8 which, via comparatively thin spokes 9, carries an annular collecting casing 10 so that this is rotatable with the rotor 1.

The rotor 1, the guide plate 8 and the collecting casing 10 are surrounded by a separator housing 11, on the inner side of which and opposite the lower edge of the collecting casing 10 is mounted an annular impact ring 12. Two supply ducts 13 for supply of unsorted material to the upper end of the top plate 2 extended down through the top of the separator housing 11.

Figure 2:
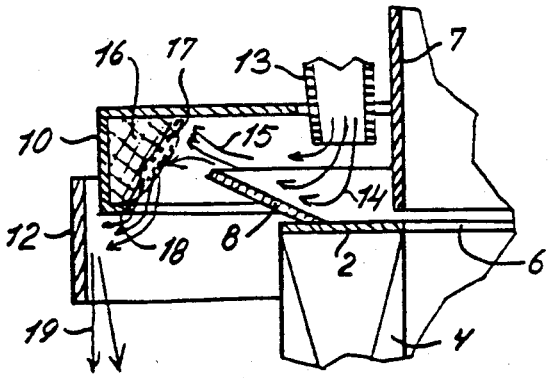
FIG. 2 is the top left part of FIG. 1 on a larger scale.

The separator operates in the following way: Unsorted material, to be separated into a fine fraction and a coarse fraction, is passed down through the inlet ducts 13 to the upper side of the top plate 2 of the rotor, as indicated by arrows 14 in FIG. 2.

Due to the rotation of the rotor the downwardly falling material is flung outwards as indicated by arrows 15 along the top plate 2 and the guide plate 8 to be stopped by the concave inner side of the collecting casing 10, which is formed with a vertical portion and a lower edge 18. On the inner side of the collecting casing is formed a comparatively stable base layer or band 16 of the material, and over this band an unstable layer 17, which, by gravity, slides comparatively slowly down towards the lower edge 18 of the collecting casing 10. From this edge 18 the material flowing down leaves the collecting casing 10 to be flung outwards against the impact ring 12. The material is stopped by the impact ring and falls down along and around the rotor 1, as indicated by arrows 19.

As it takes a certain time for the material constantly forming the material layer inside the collecting casing 10 to slide downwards, the material has sufficient retention time in the collecting casing 10 to ensure an even distribution all the way around the rotor 1 and not only in a limited zone from the inlet duct 13 in the direction of rotation of the rotor.

The conveying gas flows, as indicted by arrows 20 in FIG. 1, up around, into and out through the top of the rotor 1 to the outlet duct 7. The material 19 falling down from the impact ring 12 enters the flow 20 of conveying gas to be suspended therein.

The suspension flows in between the rotor vanes 4 where coarser particles in known manner are returned towards the wall 11 of the separator housing, from where they fall down and may be collected in a hopper (not shown) at the bottom of the separator, while the finer particles remain suspended in the conveying gas with which they leave the top of the separator for possible precipitation as a finished product in a precipitator.

It should be noted that the separator may also (as known) be equipped with a louvre system surrounding the rotor 1, and via which the conveying gas is directed towards the rotor 1. Such a louvre system may be adjustable, thus making it possible to control the direction of flow of the conveying gas flowing towards the rotor.

I claim:

1. A separator for sorting particulate material suspended in a conveying gas into a fine fraction and a coarse fraction, said separator comprising:

a rotor rotatable about a substantially vertical axis, said rotor having a top plate, a bottom plate and a plurality of vanes extending between said bottom plate and said top plate;

said top plate having a distributing arrangement for distributing supplied, unsorted material to said rotor so as to suspend said material in said conveying gas; and a housing encasing said rotor and having an outlet from the upper end of said rotor for discharge of said fine fraction after separation;

at least one inlet for the supply of said unsorted particulate material to the upper side of said rotor top plate; and an impact ring positioned around and at a radial distance from said top plate;

an annular collecting casing secured to and coaxial with said top plate and displaced at a radial distance from said material inlet such that said casing is rotatable with said rotor and said top plate, said collecting casing having a concave side facing said top plate and configured with a vertical portion and a lower edge such that material flung outwards from said top plate is collected on said casing and forms a band of material substantially around the entire circumference thereof such that the surface of said band of material slides downwardly and is distributed over the entire circumference of the rotor.

2. A separator according to claim 1, further comprising an annular guide plate oriented obliquely upwards and outwards and covering at least the radially outermost zone of said top plate such that material is caused by said annular guide plate to hit the surface of said band of material substantially perpendicularly.

3. A separator according to claim 2, wherein said guide plate is frusto-conical.

4. A separator according to claim 1, including a plurality of spokes connected to said top plate and wherein said collecting casing is mounted on said spokes.

5. A separator according to claim 2, including a plurality of spokes connected to said top plate and wherein said collecting casing is mounted on said spokes.

6. A separator according to claim 5, wherein said spokes are secured to said annular guide plate.

* * * * *